US010217451B2

(12) United States Patent
Kamdar et al.

(10) Patent No.: US 10,217,451 B2
(45) Date of Patent: Feb. 26, 2019

(54) MULTI-SPEAKER METHOD AND APPARATUS FOR LEAKAGE CANCELLATION

(71) Applicant: DTS, Inc., Calabasas, CA (US)

(72) Inventors: Suketu Kamdar, Mountain View, CA (US); Zesen Zhuang, Shanghai (CN); Martin Walsh, Scotts Valley, CA (US); Edward Stein, Aptos, CA (US); Michael M. Goodwin, Scotts Valley, CA (US); Jean-Marc Jot, Aptos, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 15/863,615

(22) Filed: Jan. 5, 2018

(65) Prior Publication Data

US 2018/0197526 A1 Jul. 12, 2018

Related U.S. Application Data

(63) Continuation of application No. 15/242,396, filed on Aug. 19, 2016, now Pat. No. 9,865,245.
(Continued)

(51) Int. Cl.
*G10K 11/178* (2006.01)
*H04R 3/12* (2006.01)
(Continued)

(52) U.S. Cl.
CPC ..... *G10K 11/1787* (2018.01); *G10K 11/178* (2013.01); *H04R 3/12* (2013.01);
(Continued)

(58) Field of Classification Search
CPC ..... G10K 11/1788; G10K 2210/3025; H04R 3/12; H04R 5/02; H04R 2430/20;
(Continued)

(56) References Cited

U.S. PATENT DOCUMENTS 5,815,578 A 9/1998 Foster et al.
2005/0271223 A1 12/2005 Itabashi et al.
(Continued)

FOREIGN PATENT DOCUMENTS

WO WO 2014/107714 7/2014

OTHER PUBLICATIONS

International Search Report and Written Opinion for International Application No. PCT/US2016/047862, Notification dated Jan. 3, 2017.

*Primary Examiner* — Mark Fischer
(74) *Attorney, Agent, or Firm* — Knobbe Martens Olson & Bear LLP

(57) ABSTRACT

Embodiments of systems and methods are described for reducing undesired leakage energy produced by a non-front-facing speaker in a multi-speaker system. For example, the multi-speaker system can include an array of forward-facing speakers, one or more upward-facing speakers, and/or one or more side-facing speakers. Filters coupled to any two of the speakers in the multi-speaker system can generate audio signals output by the coupled speakers to reduce, attenuate, or cancel a portion of an audio signal output by one or more non-front-facing speakers that acoustically propagates along a direct path from the respective non-front-facing speaker to a listening position in a listening area in front of the multi-speaker system.

21 Claims, 7 Drawing Sheets

Related U.S. Application Data

(60) Provisional application No. 62/208,418, filed on Aug. 21, 2015.

(51) Int. Cl.
*H04R 5/02* (2006.01)
*H04S 3/00* (2006.01)
*H04S 7/00* (2006.01)

(52) U.S. Cl.
CPC ..... *H04R 5/02* (2013.01); *H04S 3/002* (2013.01); *G10K 2210/3025* (2013.01); *H04R 2430/20* (2013.01); *H04R 2499/15* (2013.01); *H04S 7/301* (2013.01); *H04S 7/302* (2013.01)

(58) Field of Classification Search
CPC ..... H04R 2499/15; H04S 3/002; H04S 7/301; H04S 7/302
See application file for complete search history.

(56) References Cited

U.S. PATENT DOCUMENTS

| | | | | |
|---|---|---|---|---|
| 2007/0263888 | A1 | 11/2007 | Melanson | |
| 2009/0060236 | A1 | 3/2009 | Johnston et al. | |
| 2011/0051937 | A1 | 3/2011 | Ma et al. | |
| 2011/0064254 | A1* | 3/2011 | Li | H04R 3/12 381/334 |
| 2012/0328135 | A1 | 12/2012 | De Brujin et al. | |
| 2015/0223002 | A1 | 8/2015 | Mehta et al. | |
| 2017/0053636 | A1* | 2/2017 | Oswald | G10K 11/178 |

* cited by examiner

MULTI-SPEAKER METHOD AND APPARATUS FOR LEAKAGE CANCELLATION

CROSS-REFERENCE TO RELATED APPLICATIONS

This application is a continuation of U.S. patent application Ser. No. 15/242,396, entitled "MULTI-SPEAKER METHOD AND APPARATUS FOR LEAKAGE CANCELLATION" and filed on Aug. 19, 2016, issued as U.S. Pat. No. 9,865,245, which claims priority under 35 U.S.C. § 119(e) to U.S. Provisional Application No. 62/208,418, entitled "MULTI-SPEAKER METHOD AND APPARATUS FOR LEAKAGE CANCELLATION" and filed on Aug. 21, 2015, both of which are hereby incorporated by reference in their entireties.

BACKGROUND

Generally, sound systems include speakers aimed toward the back of a room. Some current sound systems also include speakers aimed toward the side surfaces of a room or toward the ceiling to create immersive sound via reflections. These speakers may be aimed away from the listening area. However, some undesired energy may still be received at the listening location via the direct path between the side/upward-facing speakers and the listener.

SUMMARY

One aspect of the disclosure provides a multi-speaker system for reducing undesired leakage energy. The multi-speaker system comprises a non-front-facing speaker configured to be positioned away from a listening area. The multi-speaker system further comprises a plurality of front-facing speakers configured to be positioned facing the listening area. The multi-speaker system further comprises a processor configured to apply an input audio signal to the non-front-facing speaker, the non-front-facing speaker configured to transmit the input audio signal such that the input audio signal acoustically propagates along a direct path to the listening area. The multi-speaker system further comprises a plurality of filters, where each filter in the plurality of filters corresponds to a front-facing speaker in the plurality of front-facing speakers, and where each filter in the plurality of filters is configured to: generate an attenuating signal and apply the attenuating signal to a corresponding front-facing speaker, where the plurality of attenuating signals collectively attenuate the input audio signal acoustically propagated by the non-front-facing speaker along the direct path to the listening area.

The multi-speaker system of the preceding paragraph can include any sub-combination of the following features: where the multi-speaker system further comprises a second non-front-facing speaker and a second filter corresponding to the second non-front-facing speaker, where the second filter is configured to: generate a second attenuating signal and apply the second attenuating signal to the second non-front-facing speaker, where the plurality of attenuating signals and the second attenuating signal collectively attenuate the input audio signal acoustically propagated by the non-front-facing speaker along the direct path to the listening area; where the multi-speaker system further comprises a second non-front-facing speaker, the second non-front-facing speaker configured to transmit a second input audio signal such that the second input audio signal acoustically propagates along a second direct path to the listening position in the listening area; where the plurality of attenuating signals collectively attenuate the input audio signal acoustically propagated by the non-front-facing speaker along the direct path to the listening position and the second input audio signal acoustically propagated by the second non-front-facing speaker along the second direct path to the listening position; where a first attenuating signal in the plurality of attenuating signals attenuates a portion of the input audio signal acoustically propagated along the direct path corresponding to a first range of frequencies, and where a second attenuating signal in the plurality of attenuating signals attenuates a second portion of the input audio signal acoustically propagated along the direct path corresponding to a second range of frequencies different than the first range of frequencies; where frequencies in the second range of frequencies are greater than frequencies in the first range of frequencies; where each filter is configured to receive filter coefficients from a server over a network to generate the respective attenuating signal; and where the non-front-facing speaker comprises one of a side-facing speaker or an upward-facing speaker.

Another aspect of the disclosure provides a method for canceling undesired leakage energy from a non-front-facing speaker to a listening area in front of a multi-speaker system comprising a plurality of first speakers and the non-front-facing speaker. The method comprises: applying an input audio signal to the non-front-facing speaker, the non-front-facing speaker configured to transmit the input audio signal such that the input audio signal acoustically propagates: along an indirect path that includes a reflection off a surface toward the listening area, and along a direct path to a listening position in the listening area, so that without further processing, a listener at the listening position would perceive the input audio signal acoustically propagated along the indirect path and along the direct path; generating a plurality of canceling signals directed toward the listening position in the listening area, each canceling signal of the plurality of canceling signals generated by a filter corresponding to a first speaker of the plurality of first speakers; and applying each canceling signal to the corresponding first speaker, the plurality of canceling signals collectively attenuating the input audio signal acoustically propagated by the non-front-facing speaker along the direct path to the listening position in the listening area, so that less of the input audio signal acoustically propagated along the direct path is perceivable at the listening position than would be heard without said applying.

The method of the preceding paragraph can include any sub-combination of the following features: where the multi-speaker system comprises a second non-front-facing speaker, the second non-front-facing speaker configured to transmit a second input audio signal such that the second input audio signal acoustically propagates along a second direct path to the listening position in the listening area; where the plurality of canceling signals collectively attenuate the input audio signal acoustically propagated by the non-front-facing speaker along the direct path to the listening position and the second input audio signal acoustically propagated by the second non-front-facing speaker along the second direct path to the listening position; where a first canceling signal in the plurality of canceling signals attenuates a portion of the input audio signal acoustically propagated along the direct path corresponding to a first range of frequencies, and where a second canceling signal in the plurality of canceling signals attenuates a second portion of the input audio signal acoustically propagated along the direct path corresponding to a second range of frequencies different than the first range of frequencies; where frequencies in the second range of frequencies are greater than frequencies in the first range of frequencies; where the plurality of first speakers comprises a first front-facing speaker and a second front-facing speaker, where the first front-facing speaker receives the first canceling signal and the second front-facing speaker receives the second canceling signal, and where the second front-facing speaker is located closer to the non-front-facing speaker than the first front-facing speaker; where each canceling signal of the plurality of canceling signals is generated by a filter using filter coefficients derived from measurements obtained by a microphone at the listening position or received from a server over a network; where the plurality of first speakers comprises a first front-facing speaker and a second non-front-facing speaker; and where the multi-speaker system comprises one of a soundbar, an audio/visual (A/V) receiver, a center speaker, or a television that comprises the plurality of first speakers and the non-front-facing speaker.

Another aspect of the disclosure provides a method for reducing undesired leakage energy in a multi-speaker system. The method comprises: by a hardware processor, supplying first audio signals to a plurality of first speakers configured to output audio toward a listening area; supplying second audio signals to a non-front-facing speaker configured to output the second audio signals such that the second audio signals acoustically propagate along a reflected path toward the listening area and along a direct path toward the listening area; generating a plurality of attenuating signals, each of the attenuating signals corresponding to one or more of the first speakers; and applying the plurality of attenuating signals to the first audio signals supplied to the first speakers so that the plurality of attenuating signals attenuate the second audio signals outputted by the non-front-facing speaker that acoustically propagate along the direct path.

The method of the preceding paragraph can include any sub-combination of the following features: where the method further comprises: supplying third audio signals to a second non-front-facing speaker configured to output the third audio signals such that the third audio signals acoustically propagate along a second reflected path toward the listening area and along a second direct path toward the listening area, and applying the plurality of attenuating signals to the first audio signals supplied to the first speakers so that the plurality of attenuating signals attenuate the second audio signals outputted by the non-front-facing speaker that acoustically propagate along the direct path and the third audio signals outputted by the second non-front-facing speaker that acoustically propagate along the second direct path; and where a first attenuating signal in the plurality of attenuating signals attenuates a portion of the second audio signals acoustically propagated along the direct path corresponding to a first range of frequencies, and where a second attenuating signal in the plurality of attenuating signals attenuates a second portion of the second audio signals acoustically propagated along the direct path corresponding to a second range of frequencies different than the first range of frequencies.

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

BRIEF DESCRIPTION OF THE DRAWINGS

Throughout the drawings, reference numbers are re-used to indicate correspondence between referenced elements. The drawings are provided to illustrate embodiments of the inventions described herein and not to limit the scope thereof.

DETAILED DESCRIPTION

Introduction

Figure 1:
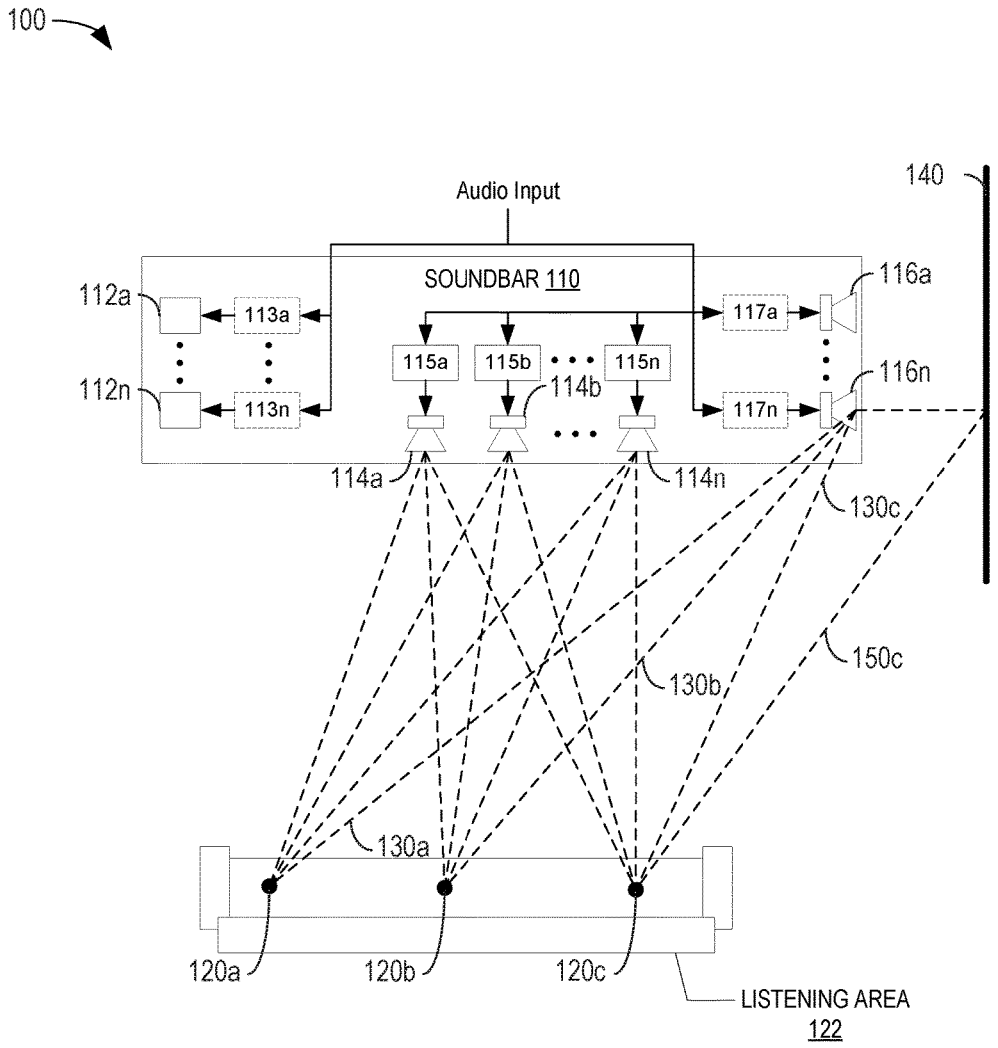
FIG. 1 is a diagram illustrating an example multi-speaker system, according to one embodiment.

As described above, side or upward-facing speakers in sound systems can sometimes produce undesired energy that is received at the listening location via the direct path between the side/upward-facing speakers and the listener. An example of this would be a soundbar using side-facing (or side-firing) and/or upward-facing (or upward-firing) speakers meant to create immersive sound via reflections within the room. The side-facing and/or upward-facing speakers may leak undesired energy into the listening area. For example, a side-facing or upward-facing speaker may transduce an audio signal that propagates acoustically to the listener via a direct path and one or more indirect paths (e.g., a path that reflects off a wall or ceiling). The propagation of the audio signal to the listener along the direct path may be considered undesired leakage energy. Larger speakers, which have higher directivity than smaller speakers, could be used to reduce the undesired leakage energy. However, larger speakers are usually impractical in soundbar applications given the relatively small size of the soundbar. Furthermore, listeners may find it more difficult to localize the physical speakers being used as desired and by design.

Accordingly, embodiments of the disclosure provide a multi-speaker system that reduces, attenuates, and/or cancels the undesired sound energy leaked into a listening area by one or more speakers in the multi-speaker system. The multi-speaker system can implement the techniques described herein to render a wider, more diffuse sound field or to render a virtual sound source that appears to originate from locations at which no speakers are present (e.g., as in the case of elevated sound effects). The techniques described herein may be useful in broadening the listening sweetspot area and/or addressing multiple listeners in a room.

The multi-speaker system may reduce, attenuate, or cancel undesired leakage energy received at the listening location via the direct path between a side and/or upward-facing speaker in the multi-speaker system (also referred to herein as the leakage speaker) and the listener. Thus, the multi-speaker system may render a better immersive listening experience in a wider listening area. For example, the multi-speaker system can include an audio device (e.g., a soundbar, a center speaker, a television, an audio/visual (A/V) receiver, a device under or above a television, etc.) that includes a portion for creating undesired leakage energy (e.g., side-facing speakers, upward-facing speakers, etc.) and a portion for reducing undesired leakage energy (e.g., front-facing speakers, filters, a processor, memory that stores instructions that can be executed by the processor to manipulate an audio input for reducing, attenuating, and/or canceling undesired leakage energy, etc.) and/or one or more loudspeakers. The audio device can include a forward-facing array of speakers, one or more side-facing speakers, and/or one or more upward-facing speakers. Two or more speakers in the forward-facing array can reduce, attenuate, or cancel the direct path energy from the side-facing and/or the upward-facing speakers, thereby causing the portion of the audio signal that propagates to the listener via the one or more indirect paths (e.g., reflections off a wall or ceiling) to become more audible. The reduction, attenuation, or cancellation of the undesired energy by speakers in the forward-facing array may also ensure virtual sound sources can be rendered with greater effect and clarity by reducing the 'precedence effect' of the leakage speaker (e.g., a psychoacoustic phenomenon in which if a listener is presented with the same sound from different directions, the sound that arrives at the listener first determines where the listener perceives the sound as coming from. Here, it is desirable that the listener perceive the sound as coming from somewhere beyond the physical extent of the soundbar 110 (e.g., the direction of a wall or ceiling along an indirect path), but the listener may instead perceive the sound as coming directly from the leakage speaker if the sound traveling along the direct path is not reduced, attenuated, or canceled).

As an example, an audio device can implement an algorithm to reduce, attenuate, and/or cancel the undesired leakage energy generated by the leakage speaker(s). By contrast, conventional techniques to reduce, attenuate, or cancel undesired leakage energy may use only one speaker. The techniques described herein may provide a benefit over conventional techniques in that using multiple speakers (e.g., in the array of front-facing speakers, side-facing speakers, and/or upward-facing speakers) to reduce, attenuate, or cancel the undesired leakage energy can provide a broader and/or more robust cancellation region. For example, a listening region may include various control points or listening positions (e.g., locations at which individual listeners are present). The leakage speaker may output an audio signal that acoustically propagates along a direct path to the first control point, along a direct path to the second control point, and so on. Given speaker characteristics, one speaker may be adequate to reduce, attenuate, or cancel the undesired leakage energy that propagates along one of the direct paths, but one speaker would be inadequate to reduce, attenuate, or cancel the undesired leakage energy that propagates along two or more of the direct paths. Thus, two or more speakers in the front-facing array can be used to reduce, attenuate, or cancel the undesired leakage energy that propagates along each direct path. This may result in a larger listening sweetspot that can address multiple listeners in a typical sound system application.

In an embodiment, the speakers used to reduce, attenuate, or cancel the undesired leakage energy can be located at any physical location. For example, the speakers can be in the front-facing array, a side-facing speaker, an upward-facing speaker, and/or the like. The geometric configuration of the speakers, however, may affect the performance of the multi-speaker system described herein. In some embodiments, a forward-facing speaker is placed close to a non-forward-facing, leakage speaker (e.g., within 30 cm, 20 cm, 10 cm, etc), such as when the upper bound of the effective frequency band outputted by the non-forward-facing speaker is high. In some embodiments, the speakers have at least a minimum spacing (e.g., at least 6 cm, 7 cm, 8 cm, etc.) between them, which may enable a more effective cancellation result.

Generally, side-facing and/or upward-facing speakers can be oriented at any angle relative to the listener to render diffuse sound and height effects. The leakage from these speakers may be reduced, attenuated, or cancelled by two or more speakers (e.g., one or more speakers in the forward-facing array of speakers, one or more side-facing speakers, and/or one or more upward-facing speakers). The arrangement of the speakers (e.g., front-facing speakers, side-facing speakers, or upward-facing speakers) can be such that they are oriented horizontally with each other, vertically with each other, and/or out of line with each other (e.g., the speakers are located within the audio device at different depths from a front, side, or top face of the audio device). In addition, the orientation of the speakers in the forward-facing array, the side-facing speakers, and/or the upward-facing speakers can change (e.g., a user can manually adjust the orientation of the speakers, the speakers can automatically adjust in response to receiving a command, etc.). Because a change in the orientation of one or more speakers can affect the performance of the undesired leakage energy reduction, filter coefficients associated with different orientations can be stored locally on the audio device and/or on a server accessible by the audio device via a network. In response to a change in the orientation of one or more speakers, the audio device can retrieve the appropriate filter coefficients to execute proper undesired leakage energy reduction or attenuation for that configuration. Additional details regarding the techniques implemented by the multi-speaker system to reduce, attenuate, or cancel undesired leakage energy are described below with respect to FIGS. 1-7.

Example Multi-Speaker System

FIG. 1 is a diagram illustrating an example multi-speaker system 100, according to one embodiment. As illustrated in FIG. 1, the multi-speaker system 100 includes a soundbar 110. However, this is merely for illustrative purposes and is not meant to be limiting. For example, the multi-speaker system 100 can include any type of audio device, such as a center speaker, a television, an A/V receiver, a device under or above a television, and/or the like. Any type of audio device can implement the techniques described herein with respect to the soundbar 110. The multi-speaker system 100 may further include other components, such as front loudspeakers, surround loudspeakers, a subwoofer, a television, and/or the like (not shown).

The soundbar 110 includes upward-facing speakers 112*a-n* (e.g., speakers that are oriented such that a front face of the speakers face a direction that is at most 89 degrees from a direction that is perpendicular to a top face of the soundbar 110, such as toward a ceiling of a room), front-facing speakers 114*a-n* (e.g., speakers that are oriented such that a front face of the speakers face a direction that is perpendicular or nearly perpendicular to a front face of the soundbar 110, toward an expected location of a listener), and/or side-facing speakers 116*a-n* (e.g., speakers that are oriented such that a front face of the speakers face a direction that is at most 89 degrees from a direction that is perpendicular to a side face of the soundbar 110, such as toward a wall of a room). Typically, the speakers 112*a-n*, 114*a-n*, and/or 116*a-n* radiate or fire in the direction that they face. However, this is not always the case. In some situations, multiple speakers may face one direction, but collectively radiate in another direction. While the soundbar 110 includes multiple upward-facing speakers 112*a-n* and side-facing speakers 116*a-n*, this is not meant to be limiting. The soundbar 110 can include any number of upward-facing speakers 112*a-n* (e.g., 0, 1, 2, 3, 4, etc.) and any number of side-facing speakers 116*a-n* (e.g., 0, 1, 2, 3, 4, etc.). The number of upward-facing speakers 112*a-n* and the number of side-facing speakers 116*a-n* may be the same or different. While the side-facing speakers 116*a-n* are depicted on the right side of the soundbar 110, the side-facing speakers 116*a-n* may be on the left and/or right side of the soundbar 110. While the upward-facing speakers 112*a-n* are depicted on the left side of the soundbar 110, the upward-facing speakers 112*a-n* may be located anywhere on the top surface of the soundbar 110.

As illustrated in FIG. 1, each front-facing speaker 114*a-n* is coupled to a corresponding filter 115*a-n*. The filters 115*a-n* may each produce an audio signal that can be output by the corresponding front-facing speakers 114*a-n* such that the front-facing speakers 114*a-n* collectively output sound to various listening positions 120*a-c* in a listening area 122 and reduce, attenuate, or cancel undesired leakage energy produced by the upward facing speakers 112*a-n* and/or the side-facing speakers 116*a-n*. For example, side-facing speaker 116*n* may output an audio signal that acoustically propagates along a direct path 130*a* to the listening position 120*a*, along a direct path 130*b* to the listening position 120*b*, along a direct path 130*c* to the listening position 120*c*, and along an indirect path 150*c* that reflects off a wall 140 toward the listening position 120*c*. The audio signal may also acoustically propagate along indirect paths to the listening positions 120*a-b* (not shown). The portion of the audio signal that propagates along paths 130*a-c* may be considered the undesired leakage energy because of the direct paths to the corresponding listening positions 120*a-c*. The portion of the audio signal that propagates along path 150*c*, however, may be considered desired energy because the reflective path creates a situation in which the audio signal appears to originate from a location at which no speakers are present (e.g., to simulate a surround sound environment). Thus, the filters 115*a-n* may each generate an audio signal that contributes to the reduction, attenuation, or cancellation of the portion of the audio signal that acoustically propagates along the paths 130*a-c*.

While not depicted, side-facing speaker 116*a* may also output an audio signal that acoustically propagates along respective direct paths to listening positions 120*a-c* that can be reduced, attenuated, or canceled by the audio signals produced by the filters 115*a-n*. For example, the filters 115*a-n* can simultaneously reduce, attenuate, or cancel undesired leakage energy produced by the side-facing speaker 116*a* and the side-facing speaker 116*n* (and any additional side-facing speakers 116). Similarly, the upward-facing speakers 112*a-n* may output audio signals that acoustically propagate along indirect paths via reflections off a ceiling of the room and acoustically propagate along respective direct paths to the listening positions 120*a-c*. The filters 115*a-n* can also reduce, attenuate, or cancel the undesired leakage energy caused by the audio signals output by the upward-facing speakers 112*a-n*.

Optionally, one or more of the upward-facing speakers 112*a-n* and the side-facing speakers 116*a-n* can, separately or in conjunction with one or more front-facing speakers 114*a-n*, reduce, attenuate, or cancel undesired leakage energy. For example, one or more of the upward-facing speakers 112*a-n* can be coupled to a corresponding filter 113*a-n* that implements the techniques described herein to reduce, attenuate, or cancel a direct path audio signal output by another speaker (e.g., another upward-facing speaker 112*a-n*, a side-facing speaker 116*a-n*, a forward-facing speaker 114*a-n*, etc.). Likewise, one or more of the side-facing speakers 116*a-n* can be coupled to a corresponding filter 117*a-n* that implements the techniques described herein to reduce, attenuate, or cancel a direct path audio signal output by another speaker (e.g., another side-facing speaker 116*a-n*, an upward-facing speaker 112*a-n*, a forward-facing speaker 114*a-n*, etc.). In some embodiments, a first non-front-facing speaker can be used with one or more front-facing speakers 114*a-n* to reduce, attenuate, or cancel the undesired leakage energy produced by a second non-front-facing speaker and the second non-front-facing speaker can be used with one or more front-facing speakers 114*a-n* to reduce, attenuate, or cancel the undesired leakage energy produced by the first non-front-facing speaker. In an illustrative example, a left front-facing speaker and a left side-facing speaker may reduce, attenuate, or cancel undesired leakage energy originating from a left upward-facing speaker and, simultaneously, the left front-facing speaker and the left upward-facing speaker may reduce, attenuate, or cancel undesired leakage energy originated from the left side-facing speaker.

In an embodiment, the filters 115*a-n* generate audio signals used to reduce, attenuate, or cancel undesired leakage energy at different frequencies. For example, the filter 115*a* may be associated with a first frequency range and the filter 115*b* may be associated with a second frequency range. The filter 115*a* can generate an audio signal that, when output by the front-facing speaker 114*a*, reduces, attenuates, or cancels undesired leakage energy that falls within the first frequency range. Similarly, the filter 115*b* can generate an audio signal that, when output by the front-facing speaker 114*b*, reduces, attenuates, or cancels undesired leakage energy that falls within the second frequency range.

A frequency range to which a filter 115*a-n* and front-facing speaker 114*a-n* combination is associated may depend on a proximity of the respective front-facing speaker 114*a-n* to the leakage speaker. For example, reducing, attenuating, or canceling a high frequency (e.g., between 1 kHz and 20 kHz) audio signal may be more effective the closer a front-facing speaker 114*a-n* is to the leakage speaker because it may be more difficult to estimate appropriate filter coefficients given the shorter wavelength of high frequency audio signals. Low frequencies (e.g., less than 1 kHz), however, can be reduced, attenuated, or canceled at similar levels even if a front-facing speaker 114*a-n* is not close to the leakage speaker. Thus, in the example depicted in FIG. 1, the filter 115*n* may generate an audio signal that can be output by the front-facing speaker 114*n* to reduce, attenuate, or cancel a high frequency portion of the audio signals output by the side-facing speaker 116*n* that acoustically propagate along the direct paths 130*a-c* because of the proximity of the front-facing speaker 114*n* to the leakage producing side-facing speaker 116*n*. The filter 115*a* may generate an audio signal that can be output by the front-facing speaker 114*a* to reduce, attenuate, or cancel a low frequency portion of the audio signals output by the side-facing speaker 116*n* that acoustically propagate along the direct paths 130*a-c* because of the relatively high distance between the positions of the front-facing speaker 114*a* and the side-facing speaker 116*n*.

In further embodiments, a filter 115*a-n* can generate an audio signal that is used to both reduce, attenuate, or cancel a high frequency audio signal output by one leakage speaker and reduce, attenuate, or cancel a low frequency audio signal output by another leakage speaker. For example, if the upward-facing speaker 112*n* and the side-facing speaker 116*n* are both generating audio signals that acoustically propagate along respective direct paths toward the listening positions 120*a-c*, the front-facing speaker 114*a* can output an audio signal generated by the filter 115*a* that reduces, attenuates, or cancels a low frequency portion of the audio signal output by the side-facing speaker 116*n* that acoustically propagates along the direct paths 130*a-c* and that reduces, attenuates, or cancels a high frequency portion of the audio signal output by the upward-facing speaker 112*n* that acoustically propagates along direct paths to listening positions 120*a-c*.

The filters 113*a-n*, 115*a-n*, and/or 117*a-n* may be coupled between the corresponding speakers 112*a-n*, 114*a-n*, and/or 116*a-n* and a decoder. The decoder may be in the soundbar 110 or another component of the multi-speaker system 100 (not shown). While filters 113*a-n*, 115*a-n*, and 117*a-n* are depicted between the speakers 112*a-n*, 114*a-n*, and 116*a-n*, respectively, and the audio input received from the decoder, each speaker 112*a-n*, 114*a-n*, and 116*a-n* may also be coupled to the decoder via a path that bypasses the filters 113*a-n*, 115*a-n*, and 117*a-n*. For example, any number of the speakers 112*a-n*, 114*a-n*, and 116*a-n* may output an audio signal that collectively or simultaneously delivers audio content to a listener and reduces, cancels, or attenuates undesired leakage energy. The filters 113*a-n*, 115*a-n*, and 117*a-n* may generate a signal to reduce, cancel, or attenuate the undesired leakage energy, but the input audio corresponding to the audio content to be delivered the listener (e.g., the nominal audio content) may bypass the filters 113*a-n*, 115*a-n*, and/or 117*a-n* when sent by the decoder to the speakers 112*a-n*, 114*a-n*, and/or 116*a-n*. In alternate embodiments, the undesired leakage energy reduction, attenuation, or cancellation audio signals generated by the filters 113*a-n*, 115*a-n*, and/or 117*a-n* can be generated when an audio input is initially encoded by a source device such that the decoded audio input can be transmitted directly to the speakers 112*a-n*, 114*a-n*, and/or 116*a-n* without any additional filtering or post-processing of the decoded audio input.

The filters 113*a-n*, 115*a-n*, and/or 117*a-n* each generate the audio signals using an audio input (e.g., as received from an A/V receiver, a television, a mobile device, etc.) and one or more filter coefficients. The filter coefficients may be derived from weights determined as part of a training process. The training process includes placing a microphone at each listening position 120*a-c* (or alternatively using microphones built in to the soundbar 110, microphones built into a remote for the soundbar 110, a microphone in a mobile device of a listener, etc.), instructing potential leakage speakers (e.g., upward-facing speakers 112*a-n*, side-facing speakers 116*a-n*, etc.) to individually output a test audio signal (e.g., a maximum length sequence), and obtaining measurements using the microphones. The listening positions 120*a-c* may be spaced such that the distance between each listening position 120*a-c* corresponds with the wavelength of a frequency of interest. The training process can be performed by a listener (e.g., the listener can place the microphones in the desired locations and instruct the soundbar 110 to initiate the training process) or by a manufacturer of the soundbar 110 prior to use by the listener.

The filter coefficients can be obtained via minimizing the undesired leakage energy at one or more listening positions 120*a-c* in the listening area 122. A processor residing in the soundbar 110 can execute instructions that minimize the undesired leakage energy. For example, the processor can use a minimization technique, such as a weighted least square algorithm, a norm function (e.g., L1-norm, L2-norm, L-infinity norm, etc.), and/or the like, to minimize the undesired leakage energy.

The processor of the soundbar 110 can receive, as an input, the measurements obtained by the one or more microphones during the training process. For each combination of potential leakage speaker and listening position 120*a-c*, the processor can use the original test audio signal and measurements captured by the microphone at the respective listening position 120*a-c* to derive a transfer function. Thus, in the example depicted in FIG. 1, the processor can derive three transfer functions for each potential leakage speaker, one for each listening position 120*a-c*. For the processor to properly determine filter coefficients, the transfer functions are derived using portions of the measurements that do not include reflections (e.g., the processor derives the transfer functions using portions of the measurements that include only the direct path). For example, if the training process is completed in an anechoic chamber (e.g., the training process is initiated by the manufacturer), then the measurements may not include reflections. However, if the training process is not completed in an anechoic chamber (e.g., the training process is initiated by the listener in a house room), the measurements can be truncated or filtered to remove reflections. Truncation or filtering can be completed manually via an inspection of a graph displaying the measurements (e.g., waveforms that include a peak following the highest peak in the measurements may be considered reflections and truncated). Alternatively, truncation or filtering can be completed automatically by the processor based on an expected time after the test audio signal is outputted to receive the direct path and/or an expected time after the test audio signal is outputted to receive one or more reflections.

In an embodiment, the processor can use the transfer functions yielded by the training process to generate a set of weights (e.g., $H_1$, $H_2$, $H_3$, etc.) optimized to reduce, attenuate, or cancel the undesired leakage energy across the wide listening area 122. For example, the processor can use a minimization technique to generate the set of weights. As an example, there may be M listening positions in the listening area 122, N forward-facing speakers, and R side-facing speakers. The listening positions, the forward-facing speakers, and the side-facing speakers may be indexed by m, n, and r, respectively. The complex transfer function, represented in the frequency domain, from forward-facing speaker n to listening position m can be denoted as $F_{nm}$. The complex transfer function for the leakage from side-facing speaker r to listening position m (e.g., the direct path between side-facing speaker r and the listening position m) can be denoted as $L_{rm}$. If the audio input is 1 in the frequency domain (e.g., the audio input is an impulse in the time domain), then the sound pressure at the listening position m is:

$$P_m = \left(\sum_{n=1}^{N} H_n F_{nm}\right) + \left(\sum_{n=1}^{N} G_r L_{rm}\right) \vec{f}_m^T \vec{H} + \vec{L}_m^T \vec{G} \tag{1}$$

where $\vec{F}_m=(F_{1m}\,F_{2m}\ldots F_{Nm})^T$, and $\vec{L}_m=(L_{1m}\,L_{2m}\ldots L_{Rm})^T$ are vectors of acoustic transfer functions from the forward-facing speakers and side-facing speakers to the m-th listening position, respectively. $\vec{G}=(G_1\ G_2\ \ldots\ G_R)^T$ and $\vec{H}=(H_1H_2\ \ldots\ H_N)^T$ are weight vectors corresponding respectively to the filters 117*a-n* and 115*a-n* in FIG. 1. The superscript T denotes the transpose operation.

For the sound pressures at all M listening positions:

$$\vec{P}=\overline{F}\vec{H}+\overline{L}\vec{G} \tag{2}$$

where $\vec{P}=(P_1P_2\ldots P_M)^T$. $\overline{F}=(\vec{F}_1\ \vec{F}_2\ \ldots\ \vec{F}_M)^T$ and $\overline{L}=(\vec{L}_1\ \vec{L}_2\ \ldots\ \vec{L}_M)^T$ are the transfer function matrices.

The weights may be selected to minimize the following cost function:

$$J(\vec{H},\vec{G})=(\overline{F}\vec{H}+\overline{L}\vec{G})^H\overline{A}(\overline{F}\vec{H}+\overline{L}\vec{G}) \tag{3}$$

where H denotes a Hermitian transpose and $\overline{A}=\mathrm{diag}(a_1\ a_2\ \ldots\ a_M)$ is a diagonal matrix of weights $a_m$ given to each listening position. The importance of an individual listening position can be tuned by these weights. The processor can then use any type of minimization technique to determine weights that minimize the cost function of Equation (3). In an embodiment, the weights for the side-facing speakers (corresponding to filters 117*a-n*), denoted by $\vec{G}$ in Equation (3), may be treated as fixed in the optimization of the cost function $J(\vec{H},\vec{G})$ such that the optimization determines the optimal weights $\vec{H}$ given the fixed weights $\vec{G}$ and the acoustic transfer function matrices $\overline{F}$ and $\overline{L}$. In some embodiments, the weights $\vec{G}$ may be designed to achieve a particular spatial response for the side-facing speakers as will be understood by those of skill in the art.

The minimization of the cost function in Equation (3) may be carried out as follows:

$$\frac{\partial J(\vec{H},\vec{G})}{\partial \vec{H}^H}=\overline{F}^H\overline{A}\overline{F}\vec{H}+\overline{F}^H\overline{A}\overline{L}\vec{G}=0 \tag{4}$$

$$\vec{H}=-\left(\overline{F}^H\overline{A}\overline{F}\right)^{-1}\overline{F}^H\overline{A}\overline{L}\vec{G} \tag{5}$$

In some embodiments, the solution may be formulated using regularization based on a parameter p to improve the robustness of the matrix inversion:

$$\vec{H}=-(\overline{F}^H\overline{A}\overline{F}+\mu I)^{-1}\overline{F}^H\overline{A}\overline{L}\vec{G} \tag{6}$$

where I is an N×N identity matrix.

In some embodiments, the number of side-firing speakers R may be 1. In such embodiments, the leakage matrix $\overline{L}$ in the formulation is reduced to a vector $\vec{L}$ consisting of the leakage responses at the M listening positions. Furthermore, the weight vector $\vec{G}$ for the side-firing speakers is reduced to a scalar that can be treated as unity without loss of generality. The result of the cost-function optimization then simplifies to:

$$\vec{H}=-(\overline{F}^H\overline{A}\overline{F}+\mu I)^{-1}\overline{F}^H\overline{A}\vec{L} \tag{7}$$

The determined weights $\vec{H}$ may be associated with a single specific frequency or specific frequency range. The processor may repeat the above optimization techniques to determine weights for other specific frequencies or specific frequency ranges. After determining weights for the various frequencies or frequency ranges, the determined weights can be combined to form a time-domain filter for each front-facing speaker. For example, the determined weights can be combined by calculating an inverse discrete Fourier transform (DFT). The result of the inverse DFT provides time-domain filter coefficients for the time-domain filters of the front-facing speakers (e.g., filters 115*a-n*).

The time-domain filtering may use multiple front-facing speakers to form an out-of-phase counterpart of the leakage pattern from the upward-facing or side-facing speakers. The embodiment described above may be referred to as a narrowband formulation in that the optimization of the weights is carried out independently in different frequency bands. While the computation by the processor is straight-forward, the narrowband formulation may provide less insight into the problem than a wideband view and may not provide a mechanism to tune the weights between different frequency ranges. In an alternate embodiment, the processor performs a wideband optimization to derive the time-domain filter coefficients directly as explained herein.

In the time domain, for forward-facing speaker n, the attenuating or cancelling signal can be generated by filtering an audio input with a length T filter $h_n[t]$ (e.g., a finite impulse response (FIR) filter), where t=0, 1, . . . , T−1. In some cases, an infinite impulse response (IIR) filter can be used to reasonably approximate the FIR filter. At the listening position m, at normalized frequency Ω, the complex sound pressure generated by all the forward-facing speakers may be:

$$Y_m(e^{j\Omega})=\sum_{n=1}^{N}H_n(e^{j\Omega})F_{nm}(e^{j\Omega})=\sum_{n=1}^{N}\left(\sum_{t=0}^{T-1}h_n[t]e^{-j\Omega t}\right)F_{nm}(e^{j\Omega}) \tag{8}$$

$$\text{where } \Omega=\frac{2\pi f}{f_s},$$

f is the frequency in Hz, and $f_s$ is the sampling rate. All of the real-valued filter coefficients $\vec{h}_n=(h_n[0],\ h_n[1],\ \ldots,\ h_n[T-1])^T$ can be stacked to form an NT×1 vector $\overrightarrow{h_{all}}=(\vec{h}_1{}^T,\ \vec{h}_2{}^T,\ \ldots,\ \vec{h}_N{}^T)^T$.

With $\vec{e}=(I,\ e^{-j\Omega},\ e^{-j2\Omega},\ \ldots,\ e^{-j(T-1)\Omega})^T$, $Y_m$ (e.g., the complex sound pressure generated by all the forward-facing speakers) can be written in the following format:

$$Y_m(e^{j\Omega})=\vec{F}_m{}^T(I\otimes\vec{e}^{\,T})\overrightarrow{h_{\mathrm{all}}}=\vec{b}_m{}^H(e^{j\Omega})\overrightarrow{h_{\mathrm{all}}} \tag{9}$$

where I is the N×N identity matrix, ⊗ represents the Kronecker product, and $\vec{F}_y$, as formulated above, is the transfer function vector from all the forward-facing speakers to the listening position m at frequency Ω. The frequency-domain sound pressure $Y_m(e^{j\Omega})$ has now been formulated with the real-valued filter coefficients $\overrightarrow{h_{all}}$ as parameters. The frequency-domain sound pressure of the leakage from the side-facing speakers at listening position m at frequency Ω can be formulated similarly as the following:

$$Z_m(e^{j\Omega})=\vec{L}_r{}^T(I\otimes\vec{e}^{\,T})\overrightarrow{g_{\mathrm{all}}}=\vec{c}_m{}^H(e^{j\Omega})\overrightarrow{g_{\mathrm{all}}} \tag{10}$$

where $\overrightarrow{g_{all}}$ is a vector of stacked real-valued coefficients for the time-domain filters 117*a-n* applied to the audio signals to be played back by the side-facing speakers.

To have an overall control of the attenuating or cancelling effect across all the listening positions and all the frequency ranges of interest (e.g., as determined by the audio to be outputted by the upward-facing or side-facing speaker), the following cost function is to be minimized:

$$J(\overrightarrow{h_{all}}) = \sum_{k=1}^{K} \sum_{m=1}^{M} a_{mk} |Y_m(e^{j\Omega_k}) + (Z_m(e^{j\Omega_k}))|^2 \tag{11}$$

where K is the number of frequency ranges of interest and $a_{mk}$ is the weight given to frequency range $\Omega_k$ at listening position m. The variable $a_{mk}$ can be used to emphasize the behavior at that space-frequency point. For example, if frequencies higher than 2 kHz are unimportant, then the corresponding $a_{mk}$ for frequencies ranges $\Omega_k$ higher than 2 kHz may be set to 0.

Expanding the squared magnitude in the Equation (11), the result is:

$$J(\overrightarrow{h_{all}}) = \overrightarrow{h_{all}}^T B \overrightarrow{h_{all}} + \overrightarrow{h_{all}}^T \vec{q} + \text{constant} \tag{12}$$

where constant denotes a term that is independent of the vector $\overrightarrow{h_{all}}$ and where $$B = \sum_{k=1}^{K} \sum_{m=1}^{M} a_{mk} \overrightarrow{b_m}(e^{j\Omega_k}) \vec{b}_m^H(e^{j\Omega_k}) \tag{13}$$

$$\vec{q} = 2\sum_{k=1}^{K} \sum_{m=1}^{M} a_{mk} \mathrm{Re}\{\overrightarrow{b_m}(e^{j\Omega_k}) \vec{c}_m^H(e^{j\Omega_k})\} \overrightarrow{g_{all}} \tag{14}$$

The filter coefficients that minimize the cost function in Equation (12) (e.g., by using a weighted-least-squares technique) can be obtained by setting the gradient $$\nabla_{\overrightarrow{h_{all}}} J$$

to zero, resulting in the following:

$$\overrightarrow{h_{all}} = (R + \mu I)^{-1} \vec{q} \tag{15}$$

where I is an identity matrix of size NT×NT and μ is a selected regularization parameter incorporated to make sure that the inverse in Equation (15) can be computed by the processor and that the calculated result is more robust and practical.

In some embodiments, the time-domain filters $h_n$ may be constrained in length, for example such that the filter length T is less than the minimum acoustic propagation time difference between the direct path 130*a-c* and the indirect path 150*c* from a side-facing position to the respective listening position 120*a-c*. The optimization of the filter coefficients may then be carried out without a separate estimation of the acoustic transfer functions F and L. In an embodiment, the filter optimization may be carried out by the processor adapting the filters $h_n$ so as to minimize the sound pressure measured at the listening positions while playing a test sequence simultaneously over the side-facing speakers and the front-facing speakers. In other embodiments, the filter optimization may be carried out by the processor adapting the filters $h_n$ so as to minimize the sound pressure measured at the listening positions in the background during playback of nominal audio content as outputted by the side-facing and/or front-facing speakers.

Figure 7:
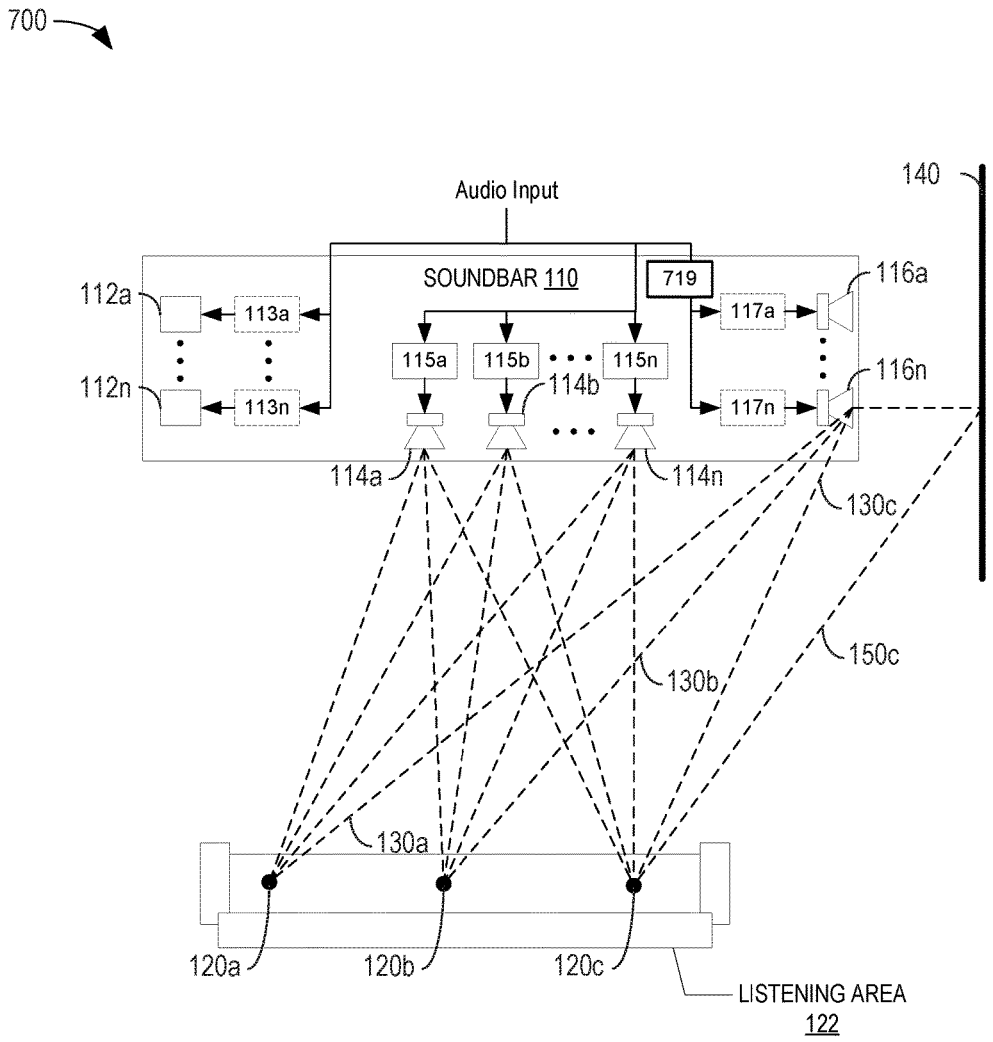
FIG. 7 is another diagram illustrating another example multi-speaker system, according to one embodiment.

To make the designed filters causal, some delay can be added to the filters and/or into the path from a decoder to the upward-facing or side-facing speaker (see FIG. 7). If delay is added into the path from the decoder to a non-front-facing speaker, the same delay may be added into the path from the decoder to other speakers (e.g., non-front-facing and/or front-facing) in the audio device. The sound pressure at the listening position m from the upward-facing or side-facing speaker can then be as follows:

$$L'_m(e^{j\Omega_k}) = e^{-j\frac{2\pi f_k T_{delay}}{f_s}} L_m(e^{j2\pi f_k/f_s}) \tag{16}$$

where $T_{delay}$ is the delay specified in samples, with a typical value of $$\frac{T}{2} \text{ or } \frac{T-1}{2}$$

samples. As an example, replacing $L_m(e^{j\Omega_k})$ with $L_m'(e^{j\Omega_k})$ can result in causal filters.

Once the processor determines the filter coefficients for the filters 113*a-n*, 115*a-n*, and/or 117*a-n*, such filter coefficients can be stored in memory of the soundbar 110. The filter coefficients can be retrieved from memory by the filters 113*a-n*, 115*a-n*, and/or 117*a-n* to generate audio signals that are audible to the listener and/or that reduce, attenuate, or cancel undesired leakage energy.

In some embodiments, the filter coefficients are stored in memory in association with an orientation of the leakage speaker (e.g., a value that indicates a current orientation of the leakage speaker). The processor can determine filter coefficients for different leakage speaker orientations, each of which are stored in the memory. The filters 113*a-n*, 115*a-n*, and/or 117*a-n* can detect an orientation of the leakage speaker and use the detected orientation to retrieve the appropriate filter coefficients from memory. Similarly, filter coefficients can be stored in memory in association with other characteristics, such as playback room characteristics or speaker setup geometries. Based on the playback room characteristics and/or the speaker setup geometries detected by the soundbar 110, the filters 113*a-n*, 115*a-n*, and/or 117*a-n* can retrieve the appropriate filter coefficients from memory.

In other embodiments, the processor does not determine and store the filter coefficients. Rather, the filter coefficients are predetermined by another computing device using the techniques described above. The filter coefficients can be stored on a network-accessible server and retrieved by the soundbar 110 as needed.

Figure 2:
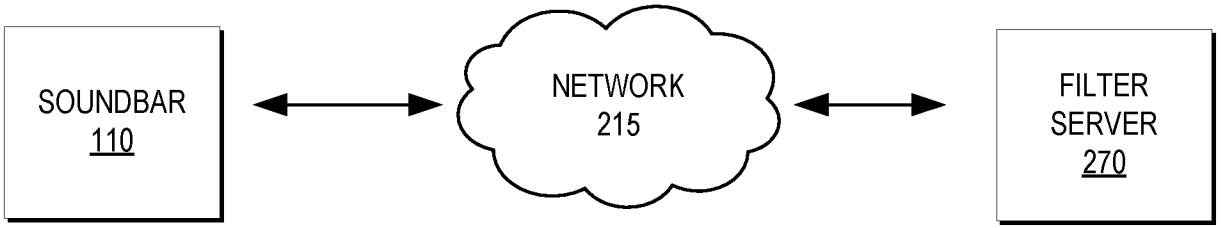
FIG. 2 illustrates a block diagram depicting the soundbar of FIG. 1 in communication with a filter server via a network, according to one embodiment.

FIG. 2 illustrates a block diagram depicting the soundbar 110 in communication with a filter server 270 via a network 215, according to one embodiment. The network 215 can include a local area network (LAN), a wide area network (WAN), the Internet, or combinations of the same. The filter server 270 can store filter coefficients associated with various leakage speaker orientations. The soundbar 110 can transmit a request for filter coefficients to the filter server 270 over the network 215, where the request includes a number of filters, a frequency range to filter, playback room characteristics, speaker setup geometries, and/or an orientation of the leakage speaker(s). The filter server 270 can determine the appropriate filter coefficients in response to the request and transmit the filter coefficients to the soundbar 110.

In still other embodiments, the filters 113*a-n*, 115*a-n*, and/or 117*a-n* may use a default set of filter coefficients. The default set of filter coefficients may be effective for a particular leakage speaker orientation. If the leakage speaker orientation is adjustable (e.g., via a screw, an electronic button that enables or disables a motor controlling the orientation of the leakage speaker, a pivot point, etc.), the soundbar 110 may indicate an optimal leakage speaker orientation. For example, the soundbar 110 can generate a notification that can be displayed in a user interface of the soundbar 110, on a television, on a mobile device running an application in communication with the soundbar 110, and/or the like.

Figure 3:
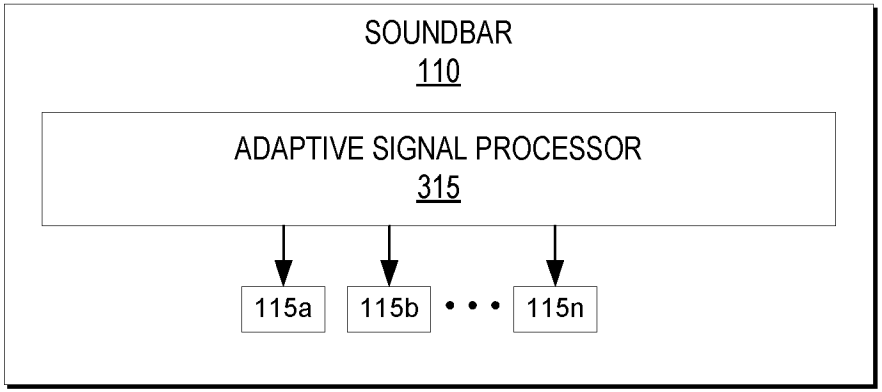
FIG. 3 illustrates a block diagram depicting the soundbar of FIG. 1 with adaptive signal processing capabilities.

In still other embodiments, the soundbar 110 can use adaptive signal processing to adjust the filter coefficients as the soundbar 110 outputs audio. FIG. 3 illustrates a block diagram depicting the soundbar 110 with adaptive signal processing capabilities. As illustrated in FIG. 3, the soundbar 110 includes an adaptive signal processor 315.

The adaptive signal processor 315 can periodically or continuously receive measurements from the microphones at the listening positions 120*a-c*, from microphones built in to the soundbar 110, from microphones built into a remote for the soundbar 110, and/or from a microphone in a mobile device of a listener. The adaptive signal processor 315 can use the measurements to determine the filter coefficients in a manner as described above. The filter coefficients can then be stored in memory and/or transmitted to the appropriate filters 115*a-n*, 113*a-n* (not shown), and/or 117*a-n* (not shown). Thus, if the leakage speaker orientation is adjusted during use of the soundbar 110 to produce audio, the soundbar 110 can adjust the filter coefficients used to generate the attenuating audio signals such that the soundbar 110 can continue to effectively reduce, attenuate, or cancel undesired leakage energy.

Figure 4:
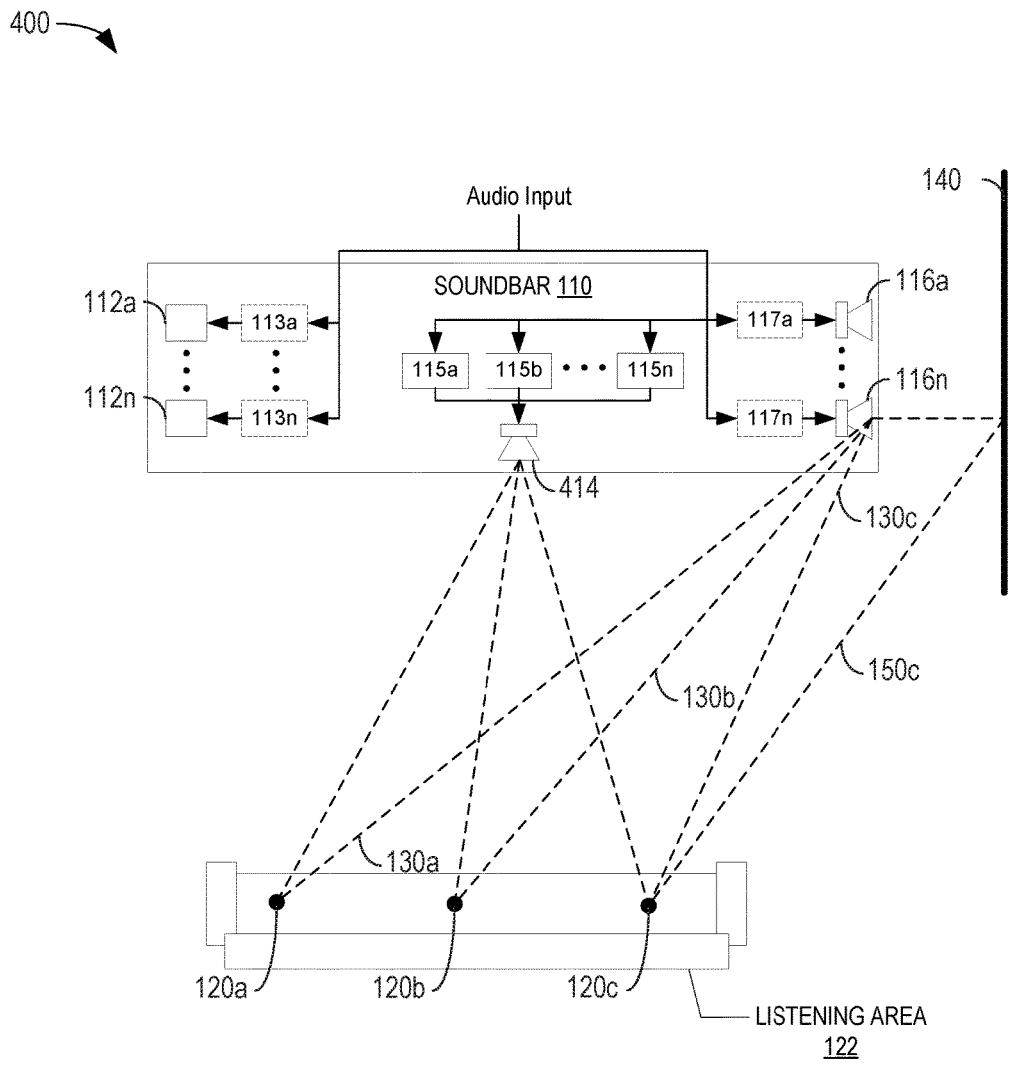
FIG. 4 is another diagram illustrating another example multi-speaker system, according to one embodiment.

FIG. 4 is another diagram illustrating another example multi-speaker system 400, according to one embodiment. As illustrated in FIG. 4, the multi-speaker system 400 is similar to the multi-speaker system 100 depicted in FIG. 1. However, the soundbar 110 may include a single front-facing speaker 414 (e.g., a single front-facing speaker driver). The filters 115*a-n* may generate audio signals that can be combined such that the front-facing speaker 414 outputs sound to the listening positions 120*a-c* and reduces, attenuates, or cancels undesired leakage energy produced by the upward facing speakers 112*a-n* and/or the side-facing speakers 116*a-n*.

Example Filter Coefficient Determination Process

Figure 5:
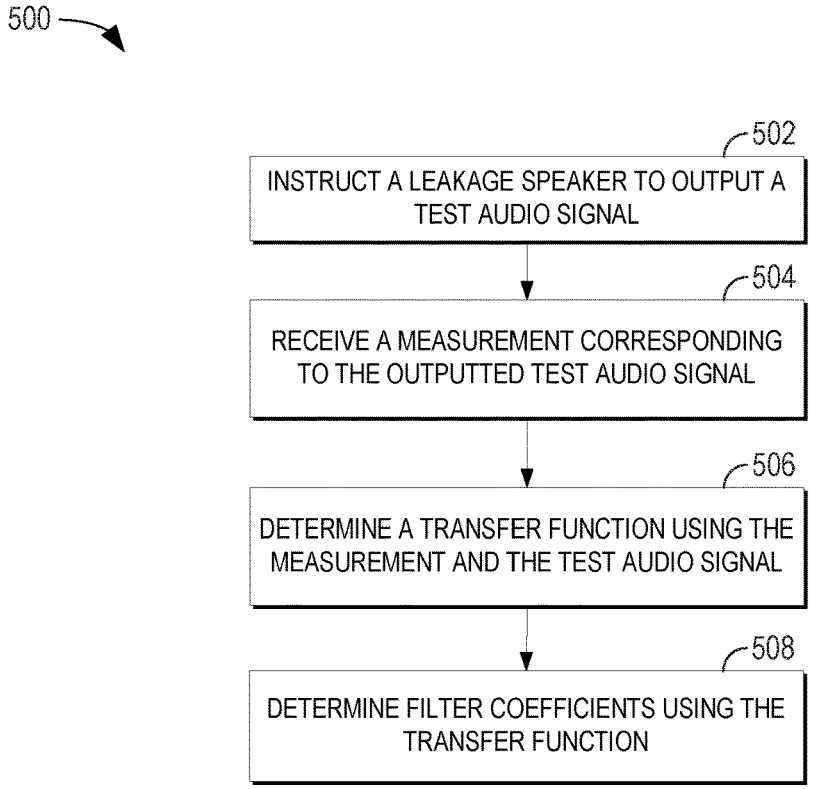
FIG. 5 illustrates an example filter coefficient determination process.

FIG. 5 illustrates an example filter coefficient determination process 500. In an embodiment, the process 500 can be performed by any of the systems described herein, including the soundbar 110 discussed above with respect to FIGS. 1-4 or a computing device external to the multi-speaker system 100. Depending on the embodiment, the process 500 may include fewer and/or additional blocks or the blocks may be performed in an order different than illustrated.

At block 502, a leakage speaker is instructed to output a test audio signal. For example, the leakage speaker can be an upward-facing speaker or a side-facing speaker in the soundbar 110. The test audio signal may be a maximum length sequence.

At block 504, a measurement corresponding to the outputted test audio signal is received. For example, the measurement may be captured by a microphone at a listening position after the leakage speaker outputs the test audio signal. The measurement may be truncated to keep the direct path response and to eliminate reflections.

At block 506, a transfer function is determined using the measurement and the test audio signal. For example, the transfer function may be associated with the listening position at which the measurement was obtained and/or with the leakage speaker.

At block 508, filter coefficients are determined using the transfer function. For example, a cost function can be derived from the transfer function and other transfer functions combined into acoustic transfer function matrices. Weights for various frequencies or frequency ranges that minimize the cost function can be determined. The determined weights can be combined by calculating an inverse DFT. The result of the inverse DFT provides time-domain filter coefficients. A minimization technique, such as a weighted least square algorithm or a norm function, can be used to minimize the cost function. The determined filter coefficients can be used by one or more filters of the soundbar 110 to reduce, attenuate, or cancel undesired leakage energy.

Example Undesired Leakage Energy Reduction Process

Figure 6:
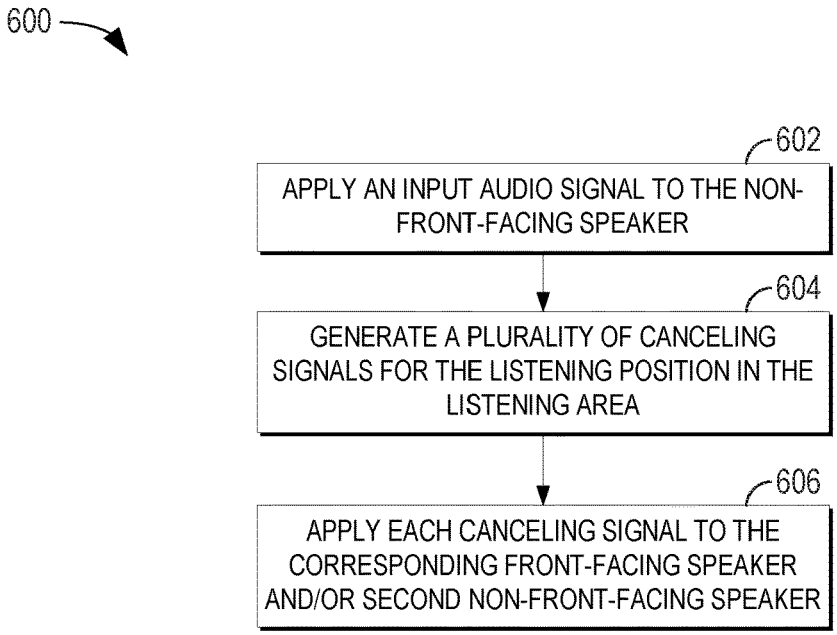
FIG. 6 illustrates an example undesired leakage energy reduction process.

FIG. 6 illustrates an example undesired leakage energy reduction process 600. In an embodiment, the process 600 can be performed by any of the systems described herein, including the soundbar 110 discussed above with respect to FIGS. 1-4. Depending on the embodiment, the process 600 may include fewer and/or additional blocks or the blocks may be performed in an order different than illustrated.

At block 602, an input audio signal is applied to the non-front-facing speaker of a multi-speaker system. For example, the non-front-facing speaker can be an upward-facing speaker or a side-facing speaker. The non-front-facing speaker may be configured to transmit an audio signal that acoustically propagates along a direct path to a listening position in a listening area and/or along an indirect path to the listening position via reflection off a wall or ceiling.

At block 604, a plurality of canceling signals is generated for the listening position in the listening area. For example, each canceling signal of the plurality of canceling signals is generated by a filter corresponding to a front-facing speaker in a plurality of front-facing speakers and/or a filter corresponding to a second non-front-facing speaker.

At block 606, each canceling signal is applied to the corresponding front-facing speaker and/or second non-front-facing speaker. The plurality of canceling signals collectively reduces, attenuates, or cancels, at the listening position, the portion of the audio signal generated by the non-front-facing speaker that acoustically propagates along the direct path to the listening position in the listening area (e.g., the plurality of canceling signals propagate to the listening position to reduce, attenuate, or cancel the undesired leakage energy).

Example Multi-Speaker System with Delay

FIG. 7 is another diagram illustrating another example multi-speaker system 700, according to one embodiment. As illustrated in FIG. 7, the multi-speaker system 700 is similar to the multi-speaker system 100 depicted in FIG. 1. However, the soundbar 110 may include a delay component 719 coupled between filters 117*a-n* and a decoder (not shown). In alternate embodiments, not shown, several delay components 719 may be present, with each coupled between a filter 117*a-n* and the corresponding side-facing speaker 116*a-n*. In still other embodiments, not shown, several delay components 719 may be present, with each included in one filter 117*a-n*. Similarly, while not depicted in FIG. 7, a delay component 719 can in addition or alternatively be placed between the decoder and filters 113*a-n*, between the filters 113*a-n* and the upward-facing speakers 112*a-n*, within the filters 113*a-n*, between the decoder and filters 115*a-n*, between the filters 115*a-n* and the front-facing speakers 114*a-n*, and/or within the filters 115*a-n*. As described above, the delay component 719 can be added to make the filters 113*a-n*, 115*a-n* and/or 117*a-n* causal.

Terminology

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the multi-speaker system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-Ray™ discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory," in addition to having its ordinary meaning, as used in this document means "enduring or long-lived". The phrase "non-transitory computer-readable media," in addition to having its ordinary meaning, includes any and all computer-readable media, with the sole exception of a transitory, propagating signal. This includes, by way of example and not limitation, non-transitory computer-readable media such as register memory, processor cache and random-access memory (RAM).

The phrase "audio signal," in addition to having its ordinary meaning, is used herein to refer to a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the multi-speaker system and method described herein, or portions thereof, may be stored, received, transmitted, or read from any desired combination of computer or machine readable media or storage devices and communication media in the form of computer executable instructions or other data structures.

Embodiments of the multi-speaker system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

What is claimed is:

1. A multi-speaker system comprising:

a plurality of first speakers;

a second speaker;

a processor configured to apply, to individual speakers in the plurality of first speakers, input audio signals, the plurality of first speakers configured to output the input audio signals such that the input audio signals acoustically propagate to a listening area via a plurality of direct paths and via a plurality of indirect paths; and a plurality of filters corresponding to the second speaker, wherein each filter in the plurality of filters is configured to generate a second signal, wherein the plurality of filters are configured to provide the second signals to the second speaker, wherein the second signals applied to the second speaker by the plurality of filters collectively at least attenuate the input audio signals acoustically propagated by the plurality of first speakers to the listening area via the plurality of direct paths to increase audibility of the input audio signals acoustically propagated to the listening area via the plurality of indirect path.

2. The multi-speaker system of claim 1, further comprising:

a third speaker; and a second filter corresponding to the third speaker, wherein the second filter is configured to:

generate a third signal, and provide the third signal to the third speaker, wherein the plurality of second signals and the third signal collectively at least attenuate the input audio signals acoustically propagated by the plurality of first speakers along the plurality of direct paths to the listening area.

3. The multi-speaker system of claim 1, wherein a first signal in the plurality of second signals attenuates a portion of the input audio signals acoustically propagated along the plurality of direct paths corresponding to a first range of frequencies, and wherein a second signal in the plurality of second signals attenuates a second portion of the input audio signals acoustically propagated along the plurality of direct paths corresponding to a second range of frequencies different than the first range of frequencies.

4. The multi-speaker system of claim 3, wherein frequencies in the second range of frequencies are greater than frequencies in the first range of frequencies.

5. The multi-speaker system of claim 1, wherein each filter is configured to receive filter coefficients from a server over a network to generate the respective second signal.

6. The multi-speaker system of claim 1, wherein the plurality of first speakers comprises at least one of a side-facing speaker or an upward-facing speaker.

7. The multi-speaker system of claim 1, wherein the multi-speaker system comprises one of a soundbar, an audio/visual (A/V) receiver, a center speaker, or a television.

8. A method for attenuating undesired leakage energy from a plurality of first speakers to a listening area in front of a speaker system comprising the plurality of first speakers and a second speaker, the method comprising:

applying, to individual speakers in the plurality of first speakers, input audio signals, the plurality of first speakers configured to output the input audio signals such that the input audio signals acoustically propagate toward the listening area via a plurality of direct paths and via a plurality of indirect paths;

generating a plurality of second signals; and outputting, by the second speaker, the plurality of second signals, the plurality of second signals collectively at least attenuating the input audio signals acoustically propagated by the plurality of first speakers via the plurality of direct paths such that the input audio signals acoustically propagated via the plurality of indirect paths are more audible than the input audio signals acoustically propagated via the plurality of direct paths.

9. The method of claim 8, wherein a first signal in the plurality of second signals attenuates a portion of the input audio signals acoustically propagated along the plurality of direct paths corresponding to a first range of frequencies, and wherein a second signal in the plurality of second signals attenuates a second portion of the input audio signals acoustically propagated along the plurality of direct paths corresponding to a second range of frequencies different than the first range of frequencies.

10. The method of claim 9, wherein frequencies in the second range of frequencies are greater than frequencies in the first range of frequencies.

11. The method of claim 9, wherein the multi-speaker system comprises a third speaker, and wherein the method further comprises applying the plurality of second signals to the second speaker and a third signal to the third speaker, the plurality of second signals and the third signal collectively at least attenuating the input audio signals acoustically propagated by the plurality of first speakers along the plurality of direct paths to the listening position in the listening area.

12. The method of claim 11, wherein the second speaker comprises a first front-facing speaker and the third speaker comprises a second front-facing speaker, wherein the first front-facing speaker receives the first signal in the plurality of second signals and the second front-facing speaker receives the third signal, and wherein the second front-facing speaker is located closer to at least one of the plurality of first speakers than the first front-facing speaker.

13. The method of claim 11, wherein the second speaker comprises a front-facing speaker and the third speaker comprises a non-front-facing speaker.

14. The method of claim 8, wherein each second signal of the plurality of second signals is generated by a filter using filter coefficients derived from measurements obtained by a microphone at the listening position or received from a server over a network.

15. The method of claim 8, wherein the multi-speaker system comprises one of a soundbar, an audio/visual (A/V) receiver, a center speaker, or a television.

16. A method comprising:

by a hardware processor, supplying a first audio signal to a first speaker so that the first speaker outputs the first audio signal toward a listening area;

supplying second audio signals to a plurality of second speakers so that the plurality of second speakers output the second audio signals toward the listening area via a plurality of direct paths and via a plurality of indirect paths;

generating a plurality of second signals; and causing the first speaker to output the plurality of second signals so that the plurality of second signals at least attenuate the second audio signals outputted by the plurality of second speakers via the plurality of direct paths such that the input audio signals acoustically propagated via the plurality of direct paths are less audible than the input audio signals acoustically propagated via the plurality of indirect paths.

17. The method of claim 16, wherein a first signal in the plurality of second signals attenuates a portion of the second audio signals acoustically propagated along the plurality of direct paths corresponding to a first range of frequencies, and wherein a second signal in the plurality of second signals attenuates a second portion of the second audio signals acoustically propagated along the plurality of direct paths corresponding to a second range of frequencies different than the first range of frequencies.

18. The method of claim 17, wherein frequencies in the second range of frequencies are greater than frequencies in the first range of frequencies.

19. The method of claim 16, further comprising causing a third speaker to output a third signal, the plurality of second signals and the third signal at least attenuating the second audio signals outputted by the plurality of second speakers that acoustically propagate along the plurality of direct paths.

20. The method of claim 19, wherein the first speaker comprises a front-facing speaker and the third speaker comprises a non-front-facing speaker.

21. The method of claim 16, wherein the plurality of second signals at least attenuate the second audio signals at least at the listening area.

* * * * *